US006636177B1

(12) United States Patent
Scholz

(10) Patent No.: US 6,636,177 B1
(45) Date of Patent: Oct. 21, 2003

(54) VOLUMETRIC PHASED ARRAY ANTENNA SYSTEM

(75) Inventor: John Arthur Scholz, Den Haag (NL)

(73) Assignee: Nederlands Organisatie voor toegepast-natuurwetenschappelijk Onderzoek TNO, Delet (NL)

( * ) Notice: Subject to any disclaimer, the term of this patent is extended or adjusted under 35 U.S.C. 154(b) by 0 days.

(21) Appl. No.: 09/914,715

(22) PCT Filed: Feb. 28, 2000

(86) PCT No.: PCT/NL00/00124

§ 371 (c)(1),
(2), (4) Date: Feb. 4, 2002

(87) PCT Pub. No.: WO00/52787

PCT Pub. Date: Sep. 8, 2000

(30) Foreign Application Priority Data

Mar. 2, 1999 (NL) ..... 1011421

(51) Int. Cl.[7] ..... H01Q 3/26; G01S 3/16
(52) U.S. Cl. ..... 342/368; 342/383
(58) Field of Search ..... 342/368, 372, 342/379, 380, 383

(56) References Cited

U.S. PATENT DOCUMENTS

| | | | | |
|---|---|---|---|---|
| 3,152,330 A | | 10/1964 | Chatelain | |
| 3,680,112 A | | 7/1972 | Thomas | |
| 4,734,700 A | | 3/1988 | Brunner | |
| 5,038,149 A | | 8/1991 | Aubry et al. | |
| 5,146,230 A | * | 9/1992 | Hules | 342/372 |
| 5,767,805 A | * | 6/1998 | Aubry | 342/154 |
| 5,821,908 A | * | 10/1998 | Sreenivas | 343/753 |
| 6,292,134 B1 | * | 9/2001 | Bondyopadhyay | 342/374 |

FOREIGN PATENT DOCUMENTS

DE 26 34 111 A1 2/1978

OTHER PUBLICATIONS

Tennant et al, "A 64 Element Broad Band Volumetric Array Antenna", IEEE Antennas and Propagation Society International Symposium, Jun. 1998, pp. 1417–1420, vol. 3.*

Voles, R. et al, "Spherical Shell and Volume Arrays" IEE Proceedings–Microwave, Antennas and Propagation, Dec. 1995, pp. 498 500.*

Wilden, H. et al, "The Crow's Nest Antenna—Experimental Results", Record of the IEEE 1990 International Radar Conference, May 1990, pp. 280–285.*

Wilden, "The Crow's –Nest Radar—An Omnidirectional Phased Array System," IEEE 1980 International Radar Conference, Arlington, VA, pp. 253–258 (XP–002118329) (Apr. 28–30, 1980).

* cited by examiner

*Primary Examiner*—Gregory C. Issing
(74) *Attorney, Agent, or Firm*—Leydig, Voit & Mayer

(57) ABSTRACT

A volumetric phased array antenna system comprising a number of antenna elements, each of which is connected to a T/R (transmitter/receiver) module, being under the control of a beam steering computer (BSC), to which T/R module a transmitting signal is fed for forming a transmitting beam, via which T/R modules RF signals are received and via a radar receiver are fed to a signal processing unit connected thereto. The antenna elements are arranged in mutually spaced conformal curved virtual surfaces having the same center of curvature or the same centers of curvature, with each combination of antenna elements in one or more surfaces together forming a volumetric phased array antenna or a part thereof.

3 Claims, 4 Drawing Sheets

VOLUMETRIC PHASED ARRAY ANTENNA SYSTEM

FIELD OF THE INVENTION

The present invention relates to a volumetric phased array antenna system whose antenna elements are spatially arranged in three dimensions and which is often referred to as Crow's Nest Antenna (CNA).

More concretely, the invention relates to a volumetric phased array antenna system comprising a number of antenna elements, each of which is connected to a T/R (transmitter/receiver) module, which is under the control of a beam steering computer (BSC), to which T/R module a transmitting signal is fed for forming a transmitting beam, and via which T/R modules RF signals are received and via a radar receiver are fed to a signal processing unit connected thereto. Such a volumetric phased array antenna system is known from H. Wilden, The crow's nest radar-an omnidirectional phased array system, IEEE International Radar Conference, Arlington 1980, p. 253–258.

BACKGROUND OF THE INVENTION

As is the case with all antenna systems, the CNA too is sensitive to interference sources, the signals from which are received in the side lobes of the antenna pattern. In military systems, interference signals are produced by the enemy to make intercommunication or target position measurements impossible. In civilian systems, such interfrence is caused by neighboring transmitting stations or by reflections from nearby objects.

When in the use of conventional radar antenna systems the location of the interference source is not known, use can be made, for the purpose of suppressing such interference or limiting the interference level, of so-called adaptive nulling systems, whereby one or more auxiliary antenna are arranged close to the main antenna. If one interference source is present, one auxiliary antenna is sufficient. The pattern of the main antenna is formed by a strong main lobe and a large number of weak side lobes; the antenna pattern of the auxiliary antenna is formed by a broad lobe which extends over at least the whole angular interval of the pattern of the main antenna, that is, over the entire field of view of the main antenna, but has a strength much smaller than that of the main lobe of the pattern of the main antenna. In the case of a sufficiently strong interference source, the interference signals received via the side lobes of the pattern of the main antenna may still be stronger than the reflection signals of the radiated radar beam received therein. Via the auxiliary antenna, practically always an interference signal will be received that is stronger than the signal coming from a target. It is known to extract from the target signals and interference signals received by the two antennas the target signal received by the main antenna in the main lobe, using algorithms developed therefor; for this purpose, a so-called nulling processor is used. It is further known, when there are several sources of interference, to also deploy several auxiliary antennas. To obtain maximum signal correlation and the highest possible interference suppression, it is important in these known systems that the auxiliary antennas are arranged close to the main antenna and that they all cover the same field of view of the main antenna. In planar and in linear phased array antennas, this is achieved by placing the auxiliary antennas in the same plane or in the same line as the main antenna. In a CNA this is not possible since there is not any plane containing all antenna elements. A possible solution for suppressing interference from an unknown interference source would be to arrange a large number of auxiliary antennas around the CNA. However, each auxiliary antenna requires its own receiver with pulse compression facility, Doppler processing, and so forth, so that the costs of such a solution become extremely high.

BRIEF SUMMARY OF THE INVENTION

The object of the invention is to provide a design of a volumetric phased array antenna system, such that in a of relatively simple manner and at relatively low cost, an efficient suppression of interference can be realized in it.

To achieve this object, according to the invention, the volumetric phased array antenna system such as described in the preamble is characterized in that the antenna elements are arranged in mutually spaced conformal curved virtual surfaces having the same center of curvature or the same centers of curvature, with each combination of antenna elements in one or more surfaces together forming a volumetric phased array antenna or a part thereof.

Insofar as these surfaces have one and the same center of curvature, the virtual surfaces referred to form spherical shells or parts thereof. Thus, for instance, six of such spherical shells can be present, with each spherical shell potentially containing tens to hundreds of antenna elements. When these spherical shells are numbered 1 to 6 from the perimeter to the center, it holds, for instance, that the antenna elements in the outermost shell (shell 1) form an antenna for a weak and narrow beam, that the antenna elements in the innermost shell (shell 6) form an antenna for a weak and wide beam, that the antenna elements in, for instance, the outermost four shells (shells 1–4) form an antenna for a strong and narrow beam, and the antenna elements of the innermost four shells (shells 3–6) form an antenna for a strong and wide beam. It will be clear that all kinds of combinations of shells are possible. Thus, for instance, a main antenna can also be obtained by combining the antenna elements in the shells 1–5, and for the purpose of interference suppression an auxiliary antenna can be obtained by combining, for instance, the antenna elements in the shells 5 and 6. In all of these combinations, it is also possible, as in the planar array systems, to generate antenna patterns with several beams oriented in different directions.

The antenna elements located on the same virtual surface are connected via a T/R module to a single combination unit, while for an antenna pattern to be formed, a number of these combination units are connected to a further combination unit. If the antenna elements are to form, for instance, two antenna patterns where conventionally two discrete antennas would have to be used, two of such further combination units will be present. In this way, it is possible to form a fixed combination of antenna patterns, for instance a main antenna pattern and, for the purpose of interference suppression, two auxiliary antenna patterns. In such a situation, separate radar receivers for frequency down-conversion and detection of the radar signals will be connected to the further combination units, whereafter the thus detected signals can be further processed in a nulling processor. More difficult is the situation where the choice of the number of antenna patterns to be formed and the properties thereof has not been fixed. The further combination unit is then formed by a matrix switching unit for forming a number of antenna patterns that is to be set as desired, with beam properties that are to be set as desired. This measure therefore means that the discrete combination units are grouped as desired. This choice can naturally depend on, for instance, the extent of interference suppression in the nulling processor. A consequence of this setup, however, is that the discrete combination units must be connected directly to a radar receiver for frequency down-conversion and detecting the radar signals before these are fed to the matrix switching unit, which may render the costs of the entire radar system high again, after all. In practice, however, in, for instance, an interference suppression system with a main antenna pattern and one or two auxiliary antenna patterns, a fixed grouping of combination units will suffice.

Through the measures according to the invention, the following further advantages are obtained. Because the main antenna and auxiliary antennas are assembled into one integrated whole, this enables proper correlation of the signals obtained via these antennas, and hence proper interference suppression. The number of auxiliary antennas can be set as desired. The auxiliary antennas can be chosen so as to yield, to a considerable extent, the same antenna gain in all directions and hence equal interference suppression in virtually all directions. When the location of an interference source is known, the auxiliary antenna can be given an increased antenna gain in the direction of the interference source through steering by means of the beam steering computer, thus enabling further improved interference suppression.

In addition to being used for suppressing interference in military and civilian radar systems, the present invention can also be used for communication purposes.

When, for instance, in a communication system two users 10 at widely divergent distances are to be simultaneously served from the same communication station, then, through a different choice of combining shells of antenna elements, two beams in the direction of the respective users can be obtained simultaneously, such that the station is sufficiently sensitive to the distant user, but does not induce any saturation effects in the nearby user; in other words, the dynamic range of the receiving system of the station with an antenna construction according to the invention can be considerably limited.

When, in another example, in a communication system the service of a mobile user from a first station is taken over by a second station, then, after the takeover by the second station, it is possible in the first station, by means of a nulling system therein, to make the first station insensitive in the direction of the mobile user and hence in the direction of the second station.

BRIEF DESCRIPTION OF THE DRAWINGS

The invention will now be further elucidated with reference to the accompanying drawings. In the drawings.

DETAILED DESCRIPTION OF THE DRAWINGS

Figure 1:
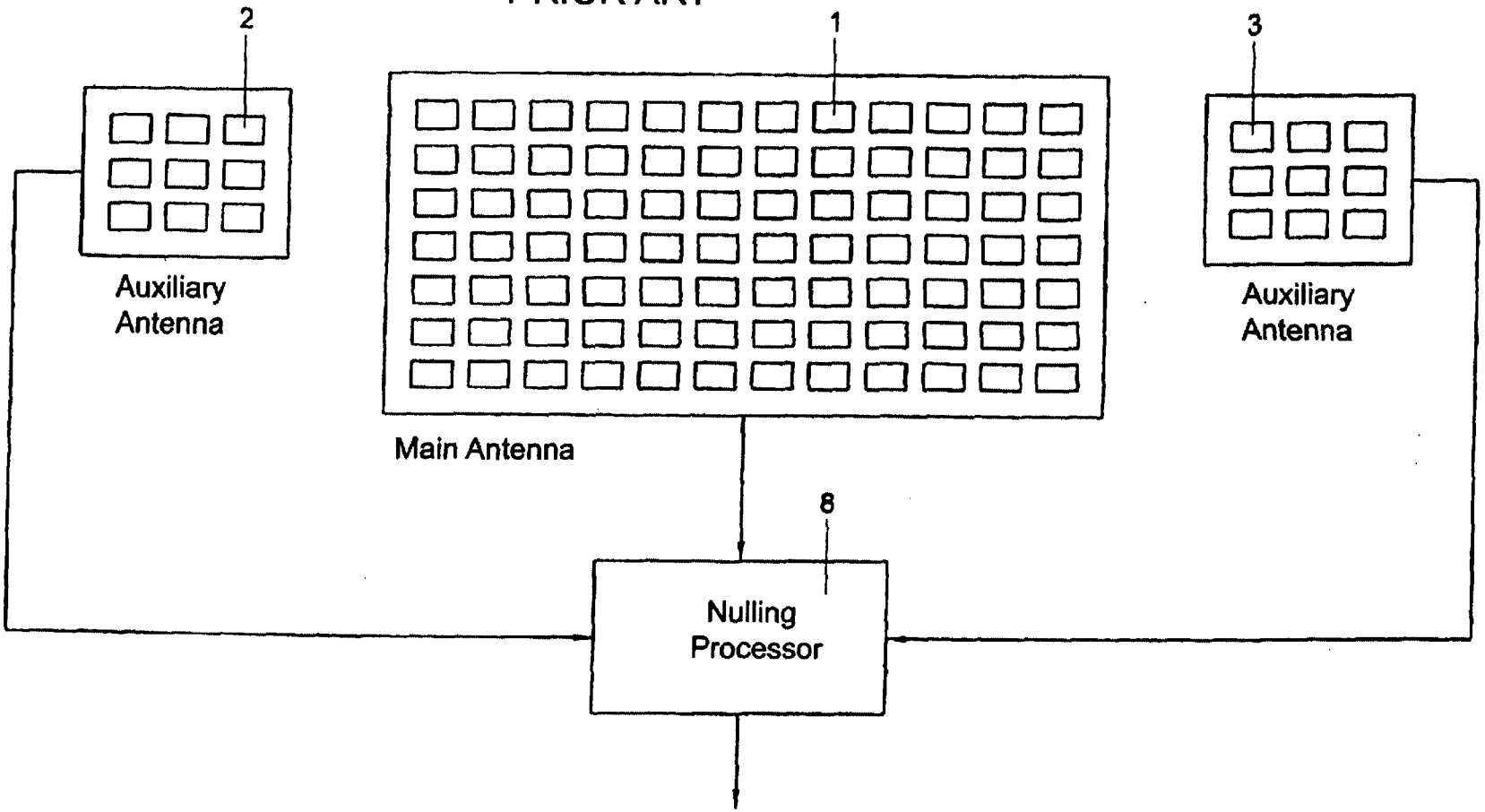
FIG. 1 PRIOR ART
FIG. 1 shows a planar array antenna system with a main antenna and an auxiliary antenna on either side thereof.
Figure 2:
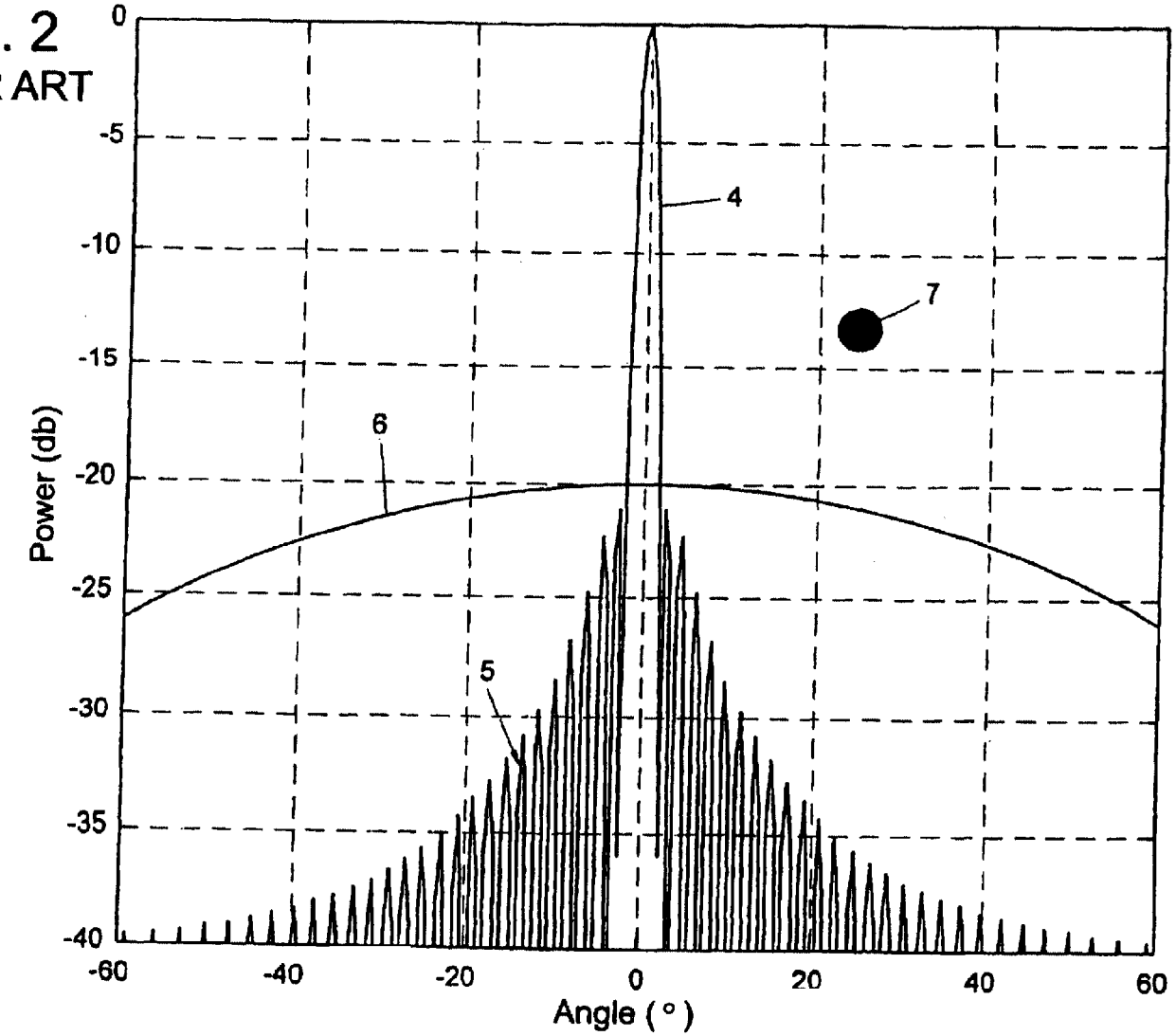
FIG. 2 PRIOR ART
FIG. 2 shows the receiving pattern of the main antenna and the auxiliary antennas in FIG. 1.

FIGS. 1 and 2 relate to an antenna system according to the prior art, having a main antenna 1 and two auxiliary antennas 2 and 3. The antennas are of the planar phased array type and have been arranged as close to each other as possible. Only via the main antenna 1 is a beam radiated. The receiving beam pattern of the antenna 1 is represented in FIG. 2 and comprises a main lobe 4 and a large number of side lobes 5. The signals stemming from a target and received within the narrow main lobe are relatively strong; the signals from the target that are received outside the main lobe rapidly decrease in strength with increasing angular deviation. The receiving beam pattern 6 of the auxiliary antennas covers the entire field of view of the main antenna, and with increasing angular deviation the received signals from the target decrease only very little in strength. In addition, in FIG. 2 an interference source 7 is indicated. The signals stemming from the target and the signals Stemming from the interference source are received by both the main antenna and the two auxiliary antennas and, in receivers not shown, subjected to frequency down-conversion and detected. The signals obtained are processed in a processing unit, in particular a nulling processor 8, whereby the unwanted interference signals are suppressed.

Figure 3:
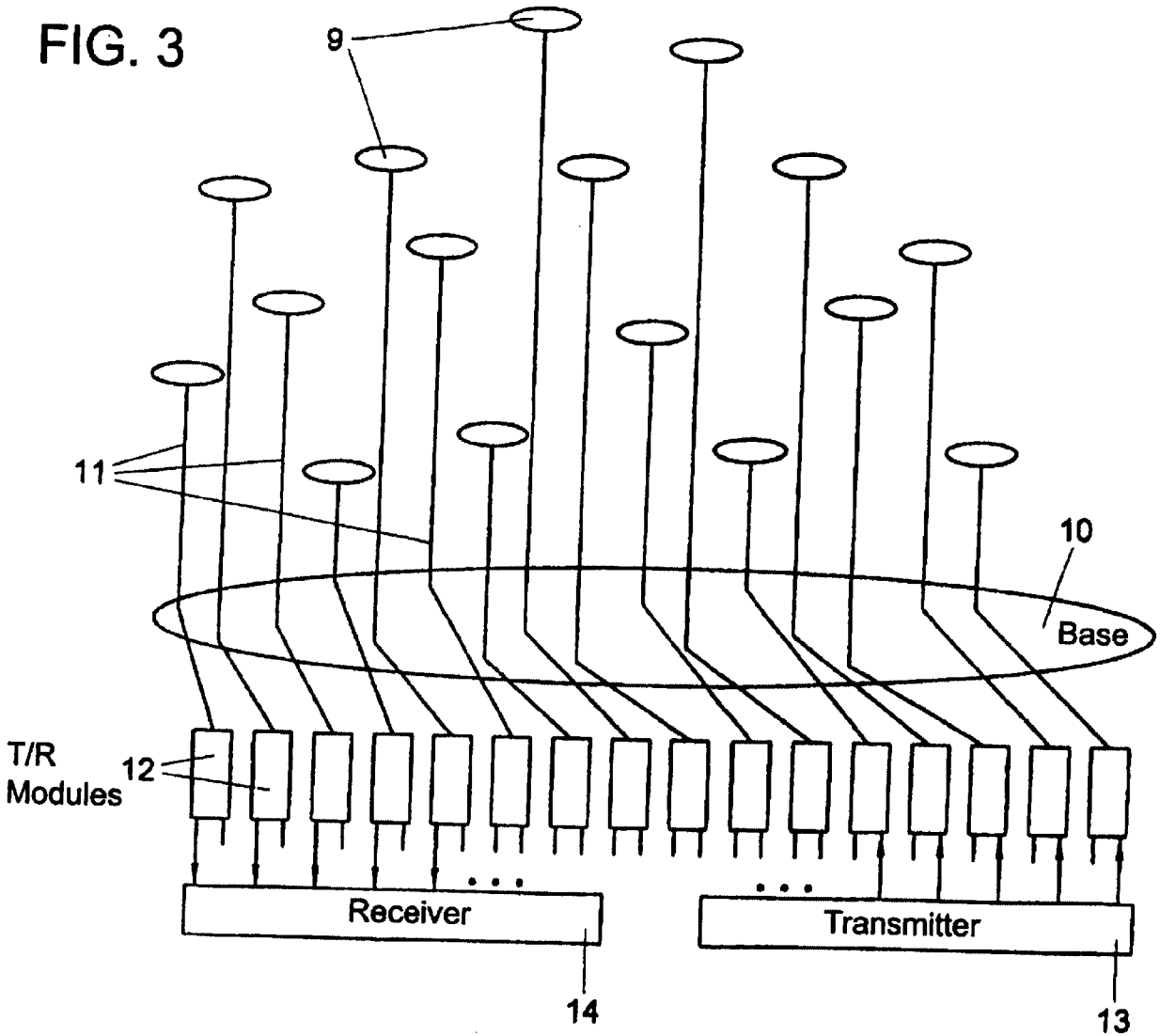
FIG. 3 shows a volumetric phased array antenna system.
Figure 4:
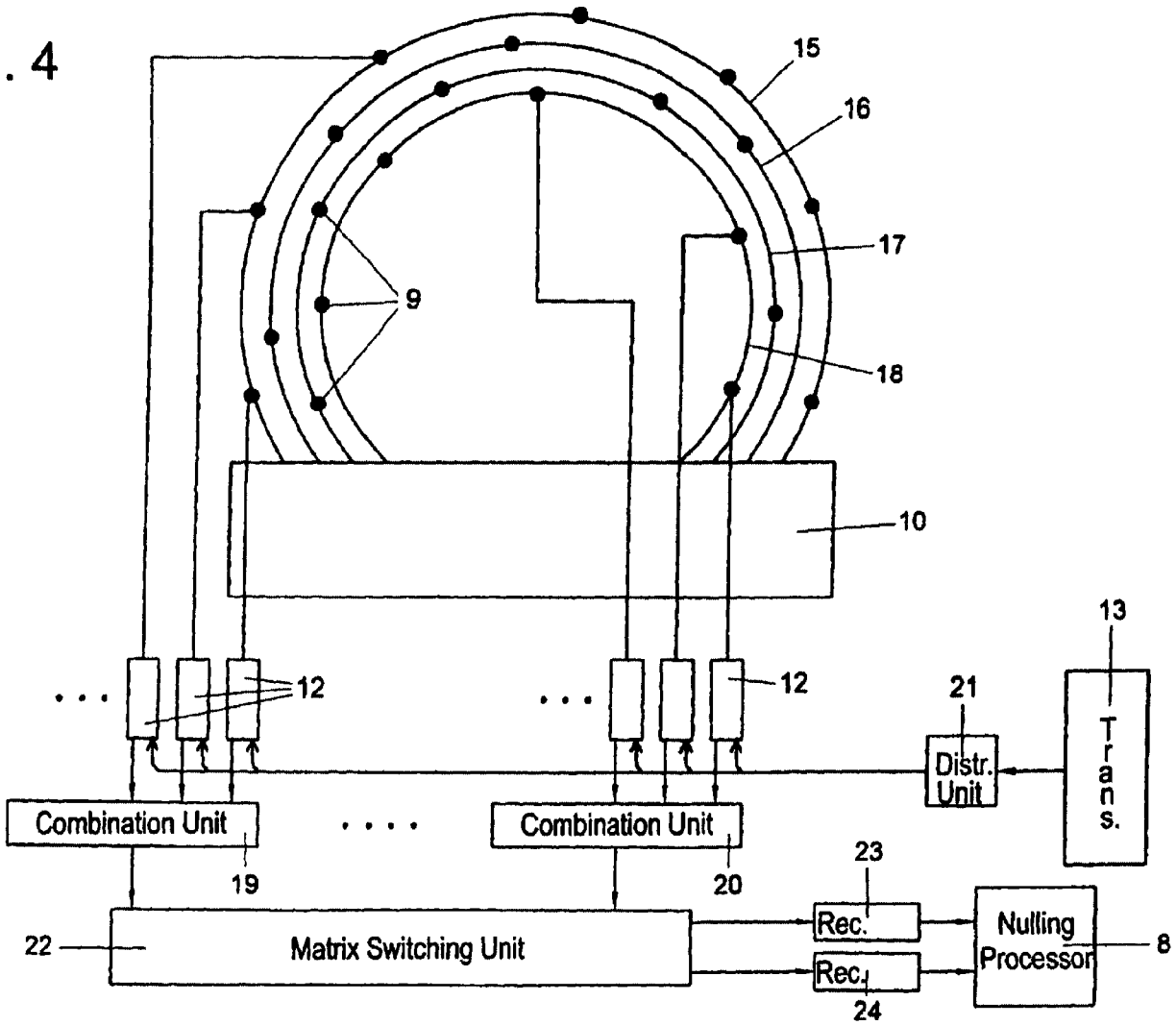
FIG. 4 shows a volumetric phased array antenna system in which the antenna elements are arranged in a shell structure and are combined per shell.

As already mentioned earlier, such a system does not straightforwardly work in the case of a volumetric phased array antenna. Such an antenna is depicted in FIG. 3. In this figure, only a limited number of spatially positioned antenna elements 9 are represented. In practice, this number will be much greater, even up to many thousands. The antenna elements 9 are disposed above a base 10. The support of the antenna elements is here formed by coax connections 11. Through these coax connections, each antenna element 9 is connected to a T/R module 12. These T/R modules in turn are connected to a transmitter 13 and a receiver 14. Signals are transmitted via the transmitter 13, the T/R modules 12 and the antenna elements 9 connected thereto, and signals are received via the antenna elements 9, the T/R modules 12 and the receiver 14. In the presence of the interference source 7 of FIG. 2, both signals reflected by the target and signals coming from the interference source are received. To still enable the interference signals to be suppressed, use is to be made again of discrete auxiliary antennas as indicated in FIG. 1, unless special measures are taken. These measures require a special manner of positioning the antenna elements 9. According to the invention, therefore, the antenna elements are disposed, in the present exemplary embodiment, so as to lie on concentric virtual surfaces of a sphere; these surfaces of a sphere are hereinafter referred to as shells. In FIG. 4, four of such shells 15–18 are indicated. When the total number of antenna elements runs up to many thousands, the number of shells can also be considerably greater. To each of the antenna elements, again a T/R module 12 is connected. The T/R modules of the antenna elements 9 belonging to a shell are connected to a combination unit. Accordingly, there are as many combination units as there are shells. In FIG. 4, only the combination units 19 and 20 are represented, which are connected to the T/R modules for the antenna elements 9 in the shells 15 and 18. A transmitting signal is transmitted by the transmitter 13 via the distributing unit 21, the T/R modules 12 and the antenna elements 9. The signals received. via the antenna elements 9 and the T/R modules 12 are combined per shell in the combination units. In the matrix switching unit 22, the information from the separate units is combined. For obtaining a beam pattern for a main antenna, for instance all shells are combined. in the matrix switching unit 22. This means that the signals of all combination units together represent the signal received by this main antenna. This signal is fed to the main antenna receiver 23 to be frequency converted and detected. For obtaining an auxiliary antenna, for instance the shells 17 and 18 are combined in the matrix switching unit 22. This means that the signals of only two combination units together represent the signal received by this auxiliary antenna. This signal is fed to the auxiliary antenna receiver 24 to be likewise frequency converted and detected. The thus detected signals are fed from the receivers 23 and 24 to the nulling processor 8 for suppressing any interference signals. Although in this exemplary embodiment the matrix switching unit 22 is tailored to a fixed shell combination, it can also be set each time, viz. by each time selecting a discrete antenna pattern tailored to a specific application, through a corresponding combination of shells. Given a large number of shells, a great multiplicity of combinations of shells are possible. In that case, it is more favorable to arrange a receiver at the output of each combination unit, and to combine the frequency converted and detected signals in the matrix switching unit 22.

The invention is not limited to the embodiment described with reference to FIG. 4, but comprises all kinds of modifications thereof, naturally insofar as they fall within the scope of protection of the following claims. It is noted here that the nulling processor forms part of a signal processing unit, in which in addition to interference suppression further video signal processing can take place.

What is claimed is:

1. A volumetric phased array antenna system comprising a number of antenna elements spatially arranged in three dimensions, and wherein each antenna element is connected to a T/R (transmitter/receiver) module, which is under the control of a beam steering computer (BSC), to which T/R module a transmitting signal is fed for forming a transmitting beam, and via which T/R modules RF signals are received and via a radar receiver arc fed to a signal processing unit connected thereto, wherein the antenna elements are arranged on a plurality of virtual surfaces which are defined by mutually-spaced, concentric shells with each combination of antenna elements in one or more surfaces forming a volumetric phased array antenna, wherein the antenna elements, located on a same virtual surface, are connected via respective T/R modules to a single combination unit, such that a single combination unit exists for each virtual surface, and wherein the combination units are further controllably combined in a further combination unit to provide different beam patterns.

2. A volumetric phased array antenna system according to claim 1, wherein for an antenna pattern to be formed, a number of combination units are connected to a further combination unit.

3. A volumetric phased array antenna system according to claim 2, wherein the further combination unit is formed by a matrix switching unit for forming an antenna pattern with a controllable beam pattern.

* * * * *